US005520826A

United States Patent [19]

Reed, Jr. et al.

[11] Patent Number: 5,520,826

[45] Date of Patent: May 28, 1996

[54] FLAME EXTINGUISHING PYROTECHNIC AND EXPLOSIVE COMPOSITION

[75] Inventors: Russell Reed, Jr.; Vicki L. Brady, both of Ridgecrest, Calif.

[73] Assignee: The United States of America as represented by the Secretary of the Navy, Washington, D.C.

[21] Appl. No.: 249,778

[22] Filed: May 16, 1994

[51] Int. Cl.[6] ..... A62D 1/06; C06B 45/06; C06B 45/10

[52] U.S. Cl. ..... 252/5; 252/4; 252/6; 252/7; 149/19.4; 149/19.6; 149/18; 149/88

[58] Field of Search ..... 252/4, 5, 6, 7; 149/19.4, 19.6

[56] References Cited

U.S. PATENT DOCUMENTS

| | | | |
|---|---|---|---|
| 3,972,820 | 8/1976 | Filter et al. | 252/4 |
| 4,358,327 | 11/1982 | Reed, Jr. et al. | 149/19.4 |
| 4,387,032 | 6/1983 | Chiesa, Jr. | 252/3 |
| 4,601,344 | 7/1986 | Reed, Jr. et al. | 169/47 |
| 4,751,027 | 6/1988 | von Werner et al. | 206/408 |
| 4,781,861 | 11/1988 | Wilson et al. | 260/349 |
| 4,861,397 | 8/1989 | Hillstrom | 149/19.4 |
| 4,938,812 | 7/1990 | Flanagan et al. | 149/19.1 |
| 4,997,497 | 3/1991 | Wilson et al. | 149/19.6 |
| 5,061,329 | 10/1991 | Reed, Jr. et al. | 149/2 |
| 5,061,330 | 10/1991 | Reed, Jr. et al. | 149/19.6 |
| 5,092,945 | 3/1992 | Reed, Jr. et al. | 149/19.4 |
| 5,164,521 | 11/1992 | Manzara et al. | 552/10 |

*Primary Examiner*—Shean C. Wu
*Assistant Examiner*—Joseph D. Anthony
*Attorney, Agent, or Firm*—Melvin J. Sliwka; John L. Forrest, Jr.

[57] ABSTRACT

A flame extinguishing pyrotechnic which flamelessly deflagrates to produce primarily nitrogen, carbon dioxide, and a fluoroolefin. The flame extinguishing characteristic is achieved by reducing the content of oxygen proximate the deflagration as well as through the flame suppressing properties of particular fluoroolefins. The pyrotechnic composition contains an azido binder such as glycidyl azide polymer (GAP), an azido plasticizer, a solid tetrazole, and a perfluorocarboxylic acid salt. This composition is cured to a rubbery composite by the addition of an isocyanate.

27 Claims, No Drawings

FLAME EXTINGUISHING PYROTECHNIC AND EXPLOSIVE COMPOSITION

BACKGROUND OF THE INVENTION

The present invention relates to gas generating fire extinguishing systems and more particularly this invention relates to nitrogen producing pyrotechnic compositions for use in fire extinguishing systems.

Bromofluorocarbons such as Halon have demonstrated excellent flame inhibiting characteristics and are therefore widely used in fire extinguishing systems. However, due to mainly environmental concerns, the manufacture and use of Halon and other bromofluorocarbon fire extinguishing systems will be precluded.

Related methods which employ fire extinguishing pyrotechnic compositions are disclosed in U.S. Pat. No. 4,601,344 (Reed Jr. et al.). The disclosed methods produced nitrogen gas and hydrogen iodide which is a corrosive and toxic flame suppressant. These gases are produced through the deflagration of a particular pyrotechnic composition. A particular disadvantage of such a method is that no dense gases are produced.

Other related art includes compositions disclosed in U.S. Pat. No. 3,972,820 (Filter et al.) where fire extinguishing pyrotechnics could be achieved from mixtures of potassium chlorate, epoxy cured polyglycols and hexabromobenzene. These compositions, however, produce relatively low levels of gas and relatively high levels of the toxic bromine derivatives.

A solid fuel pressure cartridge which releases flame extinguishing gases upon combustion has also been disclosed in U.S. Pat. No. 3,641,935. None of the related art are capable at producing a sustained yield of acceptable gases for the replacement of the Halon fire extinguishing systems.

Accordingly, there still exists a need for flame extinguishing pyrotechnics which flamelessly deflagrate and release large amounts of acceptable high density and flame inhibiting gases yet do not require periodic monitoring or checking.

SUMMARY OF THE INVENTION

The present invention provides a flame extinguishing pyrotechnic which flamelessly deflagrates to produce primarily nitrogen, carbon dioxide and a fluoroolefin such as perfluoroheptene. The flame extinguishing characteristic is achieved by reducing the content of oxygen proximate the deflagration as well as through the flame suppressing properties of hydrogen bromide.

The preferred composition contains an azido binder such as glycidyl azide polymer (GAP), an azido plasticizer, a high nitrogen content solid additive, and the potassium salt of perfluorooctanoic acid. Flame inhibiting aromatic bromine additives as well as antimony or bismuth additives are also included to promote the generation of accectable flame suppressants. This composition is cured to a rubbery composite by the addition of an isocyanate.

The present invention is very useful in extinguishing fires which are confined in areas not easily accessible. This includes certain areas on ships, aircraft, drilling rigs, as well as remote storage locations.

The compositions of the present invention are also useful in operations where the occurrence of fires is a predictable event. The occurrence of these potential fires could be minimized or avoided by providing the smothering gases and flame suppressants before the fire has a chance to ignite. Examples of such operations where the occurrence of a fire is a predictable event include airplane crashes and oil refinery accidents.

Accordingly, it is an object of the invention to provide gas generating compositions that generate large amounts of nitrogen gas, flame suppressants, and other dense gases when brought in contact with a fire in order to extinguish the fire.

Another object of the invention is to provide a flame extinguishing pyrotechnic composition which flamelessly deflagrates and releases large amounts of nitrogen gas, and other acceptable gases higher in density.

Still another object of the invention is to provide a flame extinguishing pyrotechnic composition which has a high burning rate yet produces the large amounts of fire suppressing gases at relatively cool temperatures.

An important feature of the present composition is the use of perfluoro-acid salts in conjunction with an azido binder, a plasticizer, and a high nitrogen content solid additive. The perfluoro-acid salts typically decompose at temperature ranges of about 180° C. to 250° C. to provide a dense fluorocarbon gas to absorb heat.

Another important feature of the present pyrotechnic composition is the use of a bromine additive in conjunction with an azido binder, a plasticizer, and a high nitrogen solid additive. The bromine additive will react with any water that may be present to produce a chemical flame suppressant hydrogen bromide. This additive can also produce hydrogen bromide by pyrolysis. The further addition of bismuth or antimony additives will tend to react with the bromine additive and produce different chemical flame suppressants such as bismuth tribromide, which are typically less harmful than hydrogen bromide.

An advantage of the present invention is that it provides a flame extinguishing composition for a fire extinguishing system which does not require periodic monitoring or checking.

Yet another advantage of the present fire extinguishing pyrotechnic composition is that the composition is liquid curable. This characteristic allows the pyrotechnic composition to be processed easily to form grains of various shapes to suit the specific application to which the composition will be used. A grain of a predetermined shape will burn to produce a controlled pressure-time relationship as typified by rocket motors.

The present invention satisfies the aforementioned objectives, advantages and features in a manner that is apparent from consideration of the detailed description of the invention.

DETAILED DESCRIPTION OF THE INVENTION

It has been found that compositions containing azido binders, an azide plasticizer, high nitrogen content solid additives, and perfluorocarboxylic acid salts perform exceptionally well as flame extinguishing pyrotechnics. These pyrotechnic compositions will flamelessly deflagrate to produce large amounts of nitrogen gas, carbon dioxide and dense fluorocarbons such as perfluoroheptene. Production of these compounds can be used to inhibit the formation of flames and ultimately extinguish fires.

Several fire extinguishing pyrotechnic compositions are disclosed in U.S. Pat. No. 4,601,344 (Reed Jr. et al.) which is herein incorporated by reference. The disclosed compositions include an azide binder and a high nitrogen content solid additive. The present invention relates to various improvements in the fire extinguishing compositions. Specifically, the improvements involve the addition of an azide plasticizer, perfluorocarboxylic acid salts, and/or bromine and bismuth additives.

Several binders containing azido groups have been developed which deflagrate without the formation of a flame. These are available in the form of polyols which can be cured to yield rubbery polyurethane propellants or pyrotechnics. Azido binders enhance the yield of gas from these pyrotechnics.

The properties of the various azido containing polyols are cited in Table 1. The azido groups act to increase both density and heat of formation. Binders containing azido groups tend to enhance the deflagration rate of propellants and pyrotechnics, a desirable feature in the case of pyrotechnic fire extinguishing compositions. However, other binders could be used such as polyether binders so long as the binders are able to retain an azido plasticizer. It is also possible to combine various binders and plasticizers to achieve a tailored, high nitrogen composition which will flamelessly deflagrate as well as demonstrate a high burning rate. Furthermore, some applications of the present invention may also require the composition be detonable. A detonable composition would be useful in extinguishing large masses of burning hydrocarbons such as burning oil wells or fuel storage tanks. The flexibility of the present invention allows the specific composition to be tailored to meet such requirements.

TABLE 1

Properties of Liquid Curable Azidopolyols.

| REPEATING UNIT | % N | % H | $\Delta H_T$(Cal/g) | DENSITY (g/cc) |
|---|---|---|---|---|
| GAP | 42 | 5.1 | 340 | 1.30 |
| BAMO/NMMO (71/29) | 39 | 5.1 | 330 | 1.30 |
| BAMO/NMMO (90/10) | 46 | 5.0 | 520 | 1.30 |
| BAMO/AMMO | 42.7 | 5.76 | 244 | 1.25 |

where:
GAP is glycidyl azide polymer;
BAMO/NMMO a copolymer of 3,3- bis (azidomethyl)oxetane and 3-nitratomethyl -3- methyloxetane; and
BAMO/AMMO is a copolymer of 3, 3- bis (azidomethyl)oxetane and 3-azidomethyl -3- methyloxetane.

The combination of the azido binder and azide plasticizer is preferred to ensure that the composition is liquid curable. This characteristic allows the pyrotechnic composition to be processed in a manner similar to many rocket propellants and result in grains that burn to yield a sustained release of the desired gases at constant pressures.

The preferred plasticizer is an azido terminated oligomer of glycidyl azide polymer (GAP). As mentioned earlier, various other plasticizers could be used including other azide plasticizers or non-azide plasticizers.

The high nitrogen content solid additives were selected on the basis of nitrogen content, burning rate stability, compatibility and ease of preparation. The various compounds considered together with their nitrogen and hydrogen contents, heats of formation and densities are listed in Table 2.

TABLE 2

Properties of Solid Compounds High in Nitrogen.

| COMPOUND | % N | % H | $\Delta H_T$(cal/g) | ρ |
|---|---|---|---|---|
| AMMONIUM 5-NITRAMINOTETRAZOLE | 57.3 | 2.92 | 222 | 1.49 |
| TRIAMINOGUANIDINIUM 5-NITRAMINO-TETRAZOLE | 71.8 | 4.27 | 207 | 1.49 |
| GUANYLAMINOTETRAZOLE NITRATE | 58.9 | 3.16 | 95 | 1.64 |
| TRIAMINOGUANIDINIUM NITRATE | 58.7 | 5.39 | −69 | 1.54 |
| 1,7-DIAZIDO-2,4,6-TRINITRAZAHEPTANE | 52.5 | 2.50 | 458 | 1.71 |
| NITROGUANIDINE | 53.8 | 3.85 | −209 | 1.73 |

The function of the azide groups and high nitrogen content solid additives is to provide nitrogen gas and the enthalpy release needed to vaporize the flame suppressing ingredients. The flame suppressing ingredients in the preferred embodiment are the perfluoro acid salts. Specifically, the azido binder, azide plasticizer, and high nitrogen content solid additives will undergo a reaction that produces nitrogen gas and excess heat. This heat source will yield temperatures which will decompose the salts to provide a fluorocarbon source for use as a fire suppressing agent. The perfluoro acid salts typically decompose at temperature ranges of about 180° C. to 250° C. When the perfluoro acid salts decompose, they typically release a fluoro olefin such as perfluoroheptene, a dense gas as well as carbon dioxide. The general reaction is:

$$R_fCF_2CF_2COOM \rightarrow R_fCF{=}CF_2 + CO_2 + MF$$

where: $R_f$ is a perfluoroalkyl; and M is a metal selected from the group Li, Na, K, Mg, Ca, Sr, and Ba.

The preferred perfluoro acid salt is the potassium salt of perfluorooctanoic acid. Various other perfluorocarboxylic acids such as perfluorobutyric acid can be substituted for perfluorooctanoic acid. In addition, as evident above, other perfluorocarboxylic acid salts can be used including sodium salts, magnesium salts, calcium salts and ammonium salts.

Chemical flame suppressants such as hydrogen bromide (HBr) could also be generated by the addition of compounds such as pentabromodiphenyl oxide, or decabromodiphenyl oxide which are soluble in the azido binder. The resulting flame suppressant is hydrogen bromide which is among the most effective flame suppressants although it is a corrosive and somewhat toxic gas. Less corrosive flame suppressants such as antimony bromides or bismuth bromides are preferred and would be generated by the further addition ingredients such as triphenylantimony or triphenylbismuth. Antimony halides appear to be more effective flame suppressants than the bismuth compounds but are also generally toxic. The bismuth-bromine derivatives are generally nontoxic. All of these chemical flame suppressants are characterized by the ability to form bromine atoms, a free radical scavenger which tends to disrupt the reactions involved in the typical burning process.

The chemical reactions involved in the release of these chemical flame suppressants are characterized as follows: First, any water present proximate the flame will generally react with an organo-bromine compound such as pentabromodiphenyl oxide to yield the flame suppressant hydrogen bromide and some additional pyrolyzed products including carbon monoxide and hydrogen gas. The addition of triphenylbismuth, will generally cause the hydrogen bromide to react with the triphenylbismuth to form bismuthbromide plus various pyrolyzed products. Similarly, triphenlyantimony and hydrogen bromide will react to form antimonybromide plus the pyrolyzed products. Still another reaction that occurs when a bismuth compound such as triphenylbismuth is added to the composition will result when the triphenylbismuth reacts directly with an organo-bromine compound such as pentabromodiphenyl oxide to yield additional bismith-bromide.

Various examples of a flame extinguishing pyrotechnic compositions were prepared in accordance with the ingredients and ranges identified in Table 3 and Table 4.

TABLE 3

Flame Extinguishing Pyrotechnic Composition

| GENERIC INGREDIENT | SPECIFIC INGREDIENT | % (weight) |
|---|---|---|
| AZIDO BINDER | GLYCIDYL AZIDE POLYMER (GAP) | 10.0–60.0 |
| AZIDO PLASTICIZER | AZIDO TERMINATED OLIGOMER OF GAP | 0.0–40.0 |
| High nitrogen content solid additive | AMMONIUM SALT OF 5-NITRAMINO-TETRAZOLE | 0.0–85.0 |
| PERFLUORO ACID SALT | POTASSIUM SALT OF PERFLUORO OCTANOIC ACID | 0.0–20.0 |
| BROMINE ADDITIVE | PENTABROMODIPHENYL OXIDE | 0.0–50.0 |
| Sb/Bi ADDITIVE | TRIPHENYLBISMUTH | 0.01–5.0 |
| ISOCYANATE CURATIVE | BIURET TRIMER OF HEXA-METHYLENE DIISOCYANATE | 2.0–5.0 |
| CURING CATALYST | (T-12) DIBUTYLTIN DILAURATE | 0.005–0.05 |

TABLE 4

Flame Extinguishing Pyrotechnic Compositions

| Ingredient | Example 1 (% wgt) | Example 2 (% wgt) | Example 3 (% wgt) | Example 4 (% wgt) | Example 5 (% wgt) | Example 6 (% wgt) |
|---|---|---|---|---|---|---|
| Azido Binder | 21.15 | 21.15 | 14.09 | 21.15 | 21.15 | 21.15 |
| Azido Plasticizer | | | | 10.00 | | |
| High nitrogen control solid additive | 40.00 | 40.00 | 83.33 | 50.00 | 50.00 | 63.75 |
| Perfluoro Acid Salt | 5.00 | 5.00 | | | | |
| Bromine Additive | 25.00 | 25.00 | | 15.00 | 25.00 | |
| Bismuth Additive | 5.00 | 5.00 | | | | |
| Isocyanate Curative | 3.80 | 3.80 | 2.53 | 3.80 | 3.80 | 2.28 |
| Curing Catalyst | 0.05 | 0.05 | 0.05 | 0.05 | 0.05 | 0.05 |

A preferred embodiment of the flame extinguishing pyrotechnic composition comprises; an azido binder, a plasticizer, a high nitrogen content additive, and a perfluoro acid salt is cured to a rubbery composite by the addition of an isocyanate curative such as biuret trimer or tetramer of hexamethylene diisocyanate. The bromine additives as well as antimony or bismuth additives may also be included to promote the generation of acceptable chemical flame suppressants. Preparation of the composition involves mixing the solid tetrazole, perfluoro acid salt, the isocyanate, and other additives with the liquid binder and plasticizer, and cured at about 130° F. for approximately 1 to 5 days. Having described the invention in detail those skilled in the art will appreciate that modifications may be made to the invention without departing from its spirit. Therefore, it is not intended that the scope of this invention be limited to the specific embodiment described. Rather it is intended that the scope of the invention be determined by the appending claims and their equivalents.

What we claim as the invention is:

1. A flame extinguishing pyrotechnic composition which flamelessly deflagrates to produce primarily nitrogen gas, carbon dioxide gas, and a fluoroolefin gas, the composition comprising:

(a) an azido binder;

(b) an azido plasticizer;

(c) a high nitrogen content solid additive selected from the group consisting of: Ammonium 5-Nitraminotetrazole, Triaminoguanidinium 5-Nitraminotetrazole, Guanylaminotetrazole Nitrate, Triaminoguanidinium Nitrate, 1,7 -Diazido-2,4,6-Trinitrazaheptane, and Nitroguanidine; and (d) a perfluorocarboxylic acid salt in a flame suppressing amount wherein components (a), (b), and (c) are employed in an amount sufficient to produce nitrogen gas, carbon dioxide gas, and the enthalpy needed to vaporize flame suppressing agent (d) to produce fluoroolefin gas.

2. The flame extinguishing pyrotechnic composition of claim 1 wherein the azido binder is selected from the group consisting of glycidyl azide polymer (GAP), a copolymer of 3,3-bis(azidomethyl)oxetane and 3-nitratomethyl-3-methyloxetane, and a copolymer of 3,3-bis(azidomethyl)oxetane and 3-azidomethyl-3-methyloxetane.

3. The flame extinguishing pyrotechnic composition of claim 1 wherein the azido plasticizer is an azido terminated oligomer of glycidyl azide polymer.

4. The flame extinguishing pyrotechnic composition of claim 1 wherein the perfluorocarboxylic acid salt is further comprised from a perfluorocarboxylic acid reacting with ammonium.

5. The flame extinguishing pyrotechnic composition of claim 1 wherein the perfluorocarboxylic acid salt is further comprised from the group consisting of potassium salt, sodium salt, magnesium salt, lithium salt, barium salt, strontium salt, and calcium salt.

6. The flame extinguishing pyrotechnic composition of claim 1 wherein the perfluorocarboxylic acids are selected from the group consisting of perfluorooctanoic acid, and perfluorobutyric acid.

7. The flame extinguishing pyrotechnic composition of claim 1 further comprising an isocyanate curative.

8. The flame extinguishing pyrotechnic composition of claim 7 wherein the isocyanate curative is selected from the group consisting of the biuret trimer of hexamethylene diisocyanate, and the biuret tetramer of hexamethylene diisocyanate.

9. The flame extinguishing pyrotechnic composition of claim 1 further comprising a bromine additive.

10. The flame extinguishing pyrotechnic composition of claim 9 wherein the bromine is selected from the group consisting of: pentabromodiphenyl oxide and decabromodiphenyl oxide.

11. The flame extinguishing pyrotechnic composition of claim 9 further comprising an antimony additive.

12. The flame extinguishing pyrotechnic composition of claim 9 further comprising a bismuth additive.

13. The flame extinguishing pyrotechnic composition of claim 12 wherein the bismuth additive is triphenylbismuth.

14. A flame extinguishing pyrotechnic composition which flamelessly deflagrates to produce primarily nitrogen gas, carbon dioxide gas, and a fluoroolefin gas, the composition comprising:

(a) glycidyl azide polymer (GAP);

(b) an azido terminated oligomer of glycidyl azide polymer;

(c) Ammonium 5-Nitraminotetrazole; and (d) a potassium salt of perfluorooctanoic acid in a flame suppressing amount wherein components (a), (b) and (c) are employed in an amount sufficient to produce nitrogen gas, carbon dioxide gas and the enthalpy needed to vaporize flame suppressing agent to produce fluoroolefin gas.

15. The flame extinguishing pyrotechnic composition of claim 14 further comprising an isocyanate curative.

16. The flame extinguishing pyrotechnic composition of claim 15 wherein the isocyanate curative is biuret trimer of hexamethylene diisocyanate.

17. The flame extinguishing pyrotechnic composition of claim 14 wherein the bromine additive is selected from the group consisting of: pentabromodiphenyl oxide and decabromodiphenyl oxide.

18. The flame extinguishing pyrotechnic composition of claim 17 further comprising an antimony additive triphenylantimony.

19. The flame extinguishing pyrotechnic composition of claim 17 further comprising a bismuth additive triphenylbismuth.

20. A flame extinguishing pyrotechnic composition which flamelessly deflagrates to produce primarily nitrogen gas and, carbon dioxide gas, the composition comprising:

(a) an azido binder;

(b) an azido plasticizer;

(c) a high nitrogen content solid additive selected from the group consisting of: Ammonium 5-Nitraminotetrazole, Triaminoguanidinium Guanylaminotetrazole Nitrate, Triaminoguanidinium Nitrate, 1,7-Diazido-2,4,6-Trinitrazaheptane, and Nitroguanidine;

(d) a bromine additive which is soluble in the azido binder (a) and is employed in a flame suppressing amount;

(e) a bismuth additive; and (f) an antimony additive wherein the bismuth additive; and the antimony additive are employed in an amount to react with the bromine additive (d) to form compounds which are less toxic than hydrogen bromide.

21. The flame extinguishing pyrotechnic composition of claim 20 wherein the azido binder is selected from the group consisting of glycidyl azide polymer (GAP), a copolymer of 3,3-bis(azidomethyl)oxetane and 3-nitratomethyl-3-methyloxetane, and a copolymer of 3,3-bis(azidomethyl)oxetane and 3-azidomethyl-3-methyloxetane.

22. The flame extinguishing composition of claim 20 wherein the azido plasticizer is an azido terminated oligomer of glycidyl azide polymer.

23. The flame extinguishing pyrotechnic composition of claim 20 wherein the bromine additive is selected from the group consisting of: pentabromodiphenyl oxide and decabromodiphenyl oxide.

24. The flame extinguishing pyrotechnic composition of claim 20 further comprising an antimony additive triphenylantimony.

25. The flame extinguishing pyrotechnic composition of claim 20 wherein the bismuth additive is triphenylbismuth.

26. The flame extinguishing pyrotechnic composition of claim 20 further comprising an isocyanate curative.

27. The flame extinguishing pyrotechnic composition of claim 26 wherein the isocyanate curative is selected from the group consisting of: the biuret trimer of hexamethylene diisocyanate, and the biuret tetramer of hexamethylene diisocyanate.

* * * * *